US009870018B2

(12) United States Patent
Bertani

(10) Patent No.: US 9,870,018 B2
(45) Date of Patent: Jan. 16, 2018

(54) MANOEUVRING ELEMENT WITH INTEGRATED LOCKING MEANS

(71) Applicant: ELESA S.p.A., Milan (IT)

(72) Inventor: Alberto Bertani, Monza (IT)

(73) Assignee: ELESA S.p.A., Milan (IT)

( * ) Notice: Subject to any disclaimer, the term of this patent is extended or adjusted under 35 U.S.C. 154(b) by 328 days.

(21) Appl. No.: 14/204,381

(22) Filed: Mar. 11, 2014

(65) Prior Publication Data

US 2014/0260770 A1 Sep. 18, 2014

(30) Foreign Application Priority Data

Mar. 12, 2013 (IT) ..... MI2013U0086

(51) Int. Cl.
*G05G 1/08* (2006.01)
*G05G 1/10* (2006.01)
*G05G 1/02* (2006.01)

(52) U.S. Cl.
CPC ..... *G05G 1/085* (2013.01); *G05G 1/082* (2013.01); *G05G 1/10* (2013.01); *G05G 1/02* (2013.01); *Y10T 74/20612* (2015.01)

(58) Field of Classification Search
CPC ..... G05G 1/085; G05G 1/082; G05G 1/087; G05G 1/10; G05G 1/02; G05G 1/025; E05B 1/003; E05B 1/0038; Y10T 74/20744; Y10T 74/20732; H01H 19/003; A01K 89/015; A01K 89/0162; A01K 89/033; A01K 89/045; A01K 89/046; A01K 89/047; A01K 89/048; A01K 89/049; A01K 89/05; A01K 89/051; A01K 89/052; A01K 89/053
See application file for complete search history.

(56) References Cited

U.S. PATENT DOCUMENTS 870,327 A * 11/1907 Ulrich ..... A01K 89/015 242/259
1,890,736 A * 12/1932 Lenz ..... A01K 89/015 242/260
2,713,274 A * 7/1955 Lockwood ..... A01K 89/015 242/255
RE24,153 E * 5/1956 Lockwood ..... A01K 89/015 242/255
2,913,195 A * 11/1959 Phillips ..... E21B 47/04 242/375.1
2,938,405 A * 5/1960 West ..... G05G 1/085 403/246
3,137,276 A * 6/1964 Weisser ..... B43K 24/084 401/111

(Continued)

FOREIGN PATENT DOCUMENTS

FR 1532572 A * 7/1968 ..... B60J 1/17
FR 2894042 A1 * 6/2007 ..... G05G 1/085

*Primary Examiner* — Daniel D Yabut
(74) *Attorney, Agent, or Firm* — Pearne & Gordon LLP

(57) ABSTRACT

A maneuvering element consisting of a crank provided at one end with a protruding handle and at the other end with a hollow bush which actuates a rotation transmission shaft and furthermore providedwith a safety system, consisting of a button housed within a cavity obtained in the crank for the actuation of a locking pin, and with the buton there is associated a retaining feature of the locking pin axially controlled by the button and apt to rotate between a fastening position and an unlocking position.

8 Claims, 4 Drawing Sheets

(56) References Cited

U.S. PATENT DOCUMENTS

| | | | | | |
|---|---|---|---|---|---|
| 3,288,115 | A * | 11/1966 | Hechtle | B43K 24/084 | 401/110 |
| 4,549,716 | A * | 10/1985 | Warren | F16K 31/60 | 192/69.91 |
| 4,552,034 | A * | 11/1985 | Bertani | G05G 1/087 | 403/111 |
| 5,267,707 | A * | 12/1993 | Oliva | A01K 89/033 | 242/268 |
| D523,320 | S * | 6/2006 | Bertani | D8/309 | |
| 2004/0068837 | A1* | 4/2004 | Bertani | B25G 1/10 | 16/110.1 |
| 2007/0216169 | A1* | 9/2007 | Jackson, Jr. | E05B 1/0038 | 292/169 |

* cited by examiner

MANOEUVRING ELEMENT WITH INTEGRATED LOCKING MEANS

The present invention relates to a manouvring element with integrated locking means apt to control the prevention of the rotation thereof.

BACKGROUND

Such devices have been known for a long time and for a wide variety of uses and applications, in particular on machinery or equipment. Generically, they consist of a usually circular crown, from which gripping and manoeuvring means depart, possibly provided with a handle.

Depending on various requirements, the devices on the market may have or not, elements for halting the rotation of the manoeuvring shaft.

For the displacement of the moving body on which the manoeuvring element is mounted to occur only in conditions of maximum safety, and only by authorised operators, pressure-activated safety means which may be controlled from the outside are provided, to engage—when activated—the structure on which the element is mounted and prevent the rotation thereof. At the moment, such means consist of an axially moving, outwardly protruding plunger carrying internally at least a protruding pin and, in the structure on which the element is mounted, a plurality of holes apt to receive said pins.

If required, the manoeuvring element is provided with a lock of the axial movements thereof, for example in case one wants to avoid tampering or displacement errors.

As is understandable from the above-reported description, the safety means are structured so that—upon the actuation of the manoeuvring element—they protrude from the manoeuvring element, risking to cause logistics problems, since this type of devices is often provided in cramped spaces, where also a small bulk takes up significant importance.

BRIEF SUMMARY

The object of the invention is therefore to accomplish a manouvring element provided with safety means in which bulk is kept constant, both during movement and at rest.

Said object is achieved through a manoeuvring element having the features according to claim 1).

BRIEF DESCRIPTION OF DRAWINGS

The element is now going to be described in greater detail, exclusively as an example with reference to the attached drawings, wherein.

DETAILED DESCRIPTION

Figure 1:
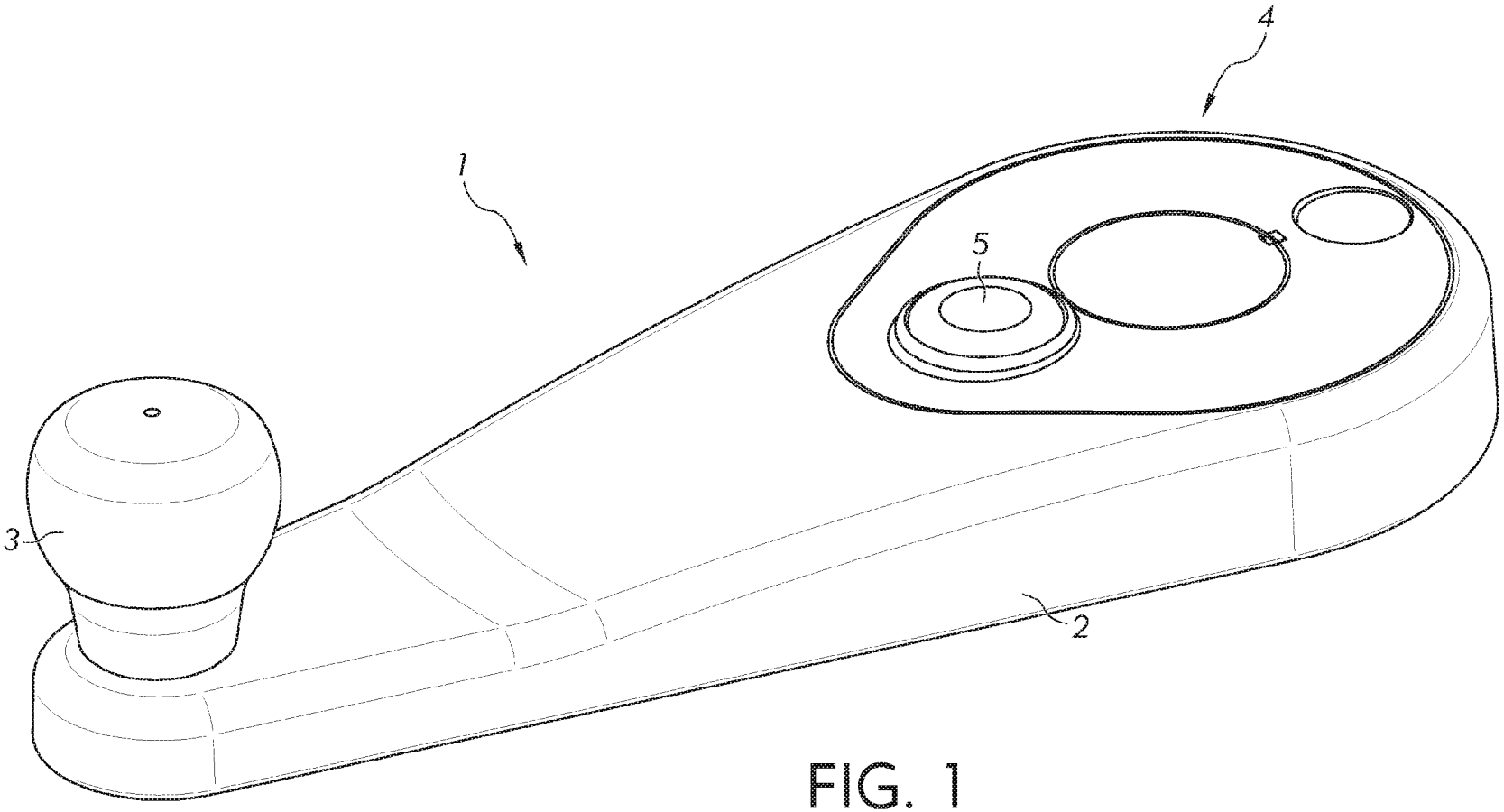
FIG. 1 is a top plan perspective view of a manoeuvring element according to the invention.
Figure 2:
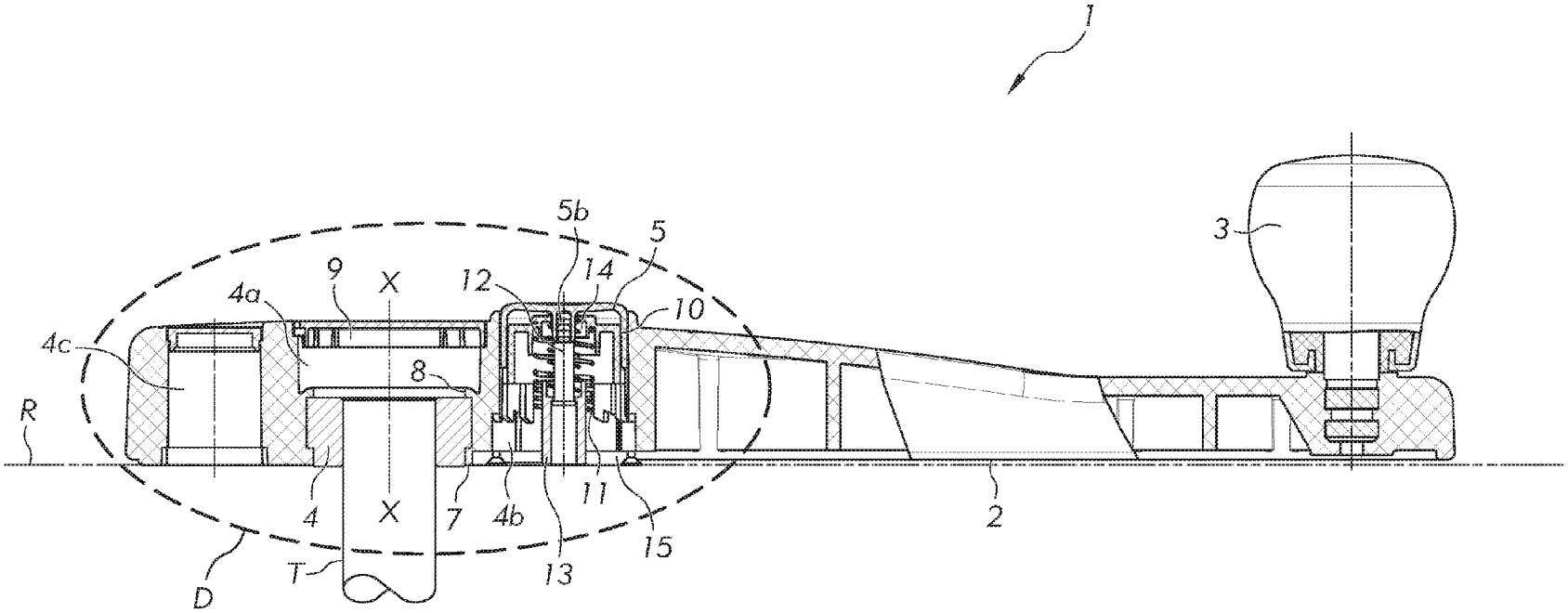
FIG. 2 is a longitudinal section view of the manoeuvring element of FIG. 1.
Figure 3C:
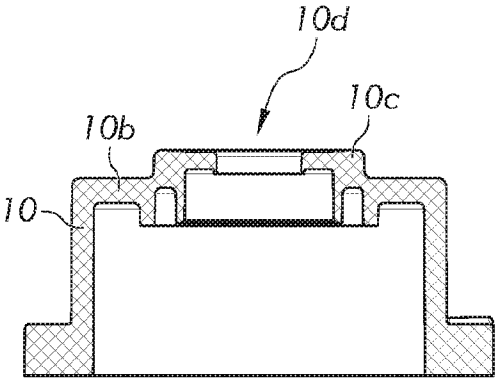
FIGS. 3*a* to 3*e* are views of the main elements which form the button body of the manoeuvring element according to the invention.
Figure 3B:
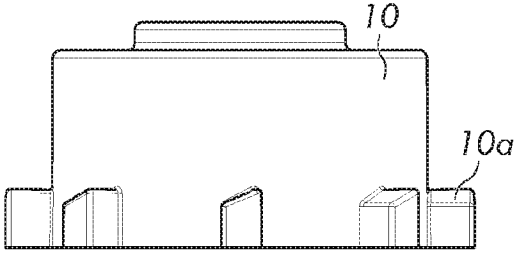
Figure 3A:
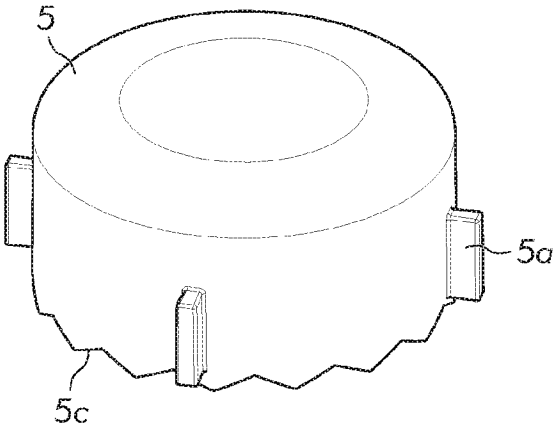
Figure 3E:
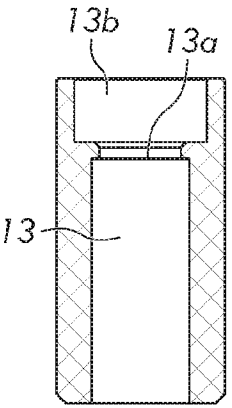
Figure 3D:
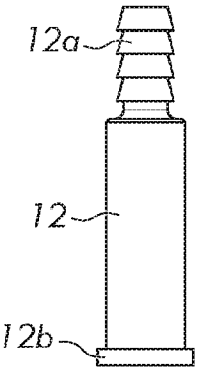

Manoeuvring element 1 consists of a crank 2, provided at one end of a protruding handle 3 and at the other end of the manoeuvring means 4 on which the above-said element 1 is applied which drive a rotation transmission shaft T inserted in a central shaped cavity 4*a*. A safety system is furthermore provided, consisting of a button 5, housed in a cavity 4*b*, and of a lock assembly 6, housed in cavity 4*c*, said button 5 and said lock assembly 6 being mutually symmetrical with respect to the x-x axis shown in FIG. 2.

More specifically, engaging means 4 consist of a hollow bush, kept in a stable position by a pair of annular, mutually parallel ribbings 7, 8, and aimed at maintaining bush 4 in the desired position.

In order to avoid the entry of dust in the transmission system, a closing cap 9 is finally provided in correspondence of the upper surface of manoeuvring element 1.

Button body 5 consists of a cylindrical body, open below, provided on the lateral surface with ribbings 5*a* for the engagement with grooves 4*d*, complementary thereto, provided along the walls of cavity 4*b*. A glass 5*b* projects from the inner surface of the upper wall, the object of which is better described in the following. Likewise, finally, the annular bottom surface 5*c* of button body 5 has a wavy pattern, the object of which will be better understood in the following.

In engagement with button means 5 is a centrally drilled rotating insert 10 externally provided with equidistant pins 10*a*, the top of which has an angle of 23° with respect to the resting plane R. It consists of a substantially cylindrical body, the top of which is an outer circular crown 10*b*, which provides centrally a bush-like insert 10*c* provided with a central hole 10*d*, of a smaller diameter with respect to crown 10*b*. Said insert 10*c*is provided—on the bottom surface thereof—with an annular groove for the housing of the upper end of a spring body 11, apt to maintain the elastic engagement between the two elements.

The engagement between button means 5 and rotating insert 10, and the displacement of the locking pin, occur through the association between a cylindrical drawing pin 12, provided with a dovetail insert 12*a*, and a preloaded pin 13, provided with a retaining bottleneck 13*a*.

The engagement between the two pins 12, 13 occurs due to the fact that pin 12 is inserted in pin 13 and has a base 12*b* having a slightly larger diameter than the diameter of retaining bottleneck 13*a*.

A spring 14 apt to maintain under tension preloaded pin 13 is housed in a chamber 13*b* provided above said bottleneck 13*a*.

As a closing to cavity 4*b*—and as a support of the safety system consisting of the coupling between the button and the rotating insert—there is a shaped flanged body 15, the central hole of which allows the displacement of the locking pin consisting of the portion below the bottleneck of preloaded pin 13.

Figure 4B:
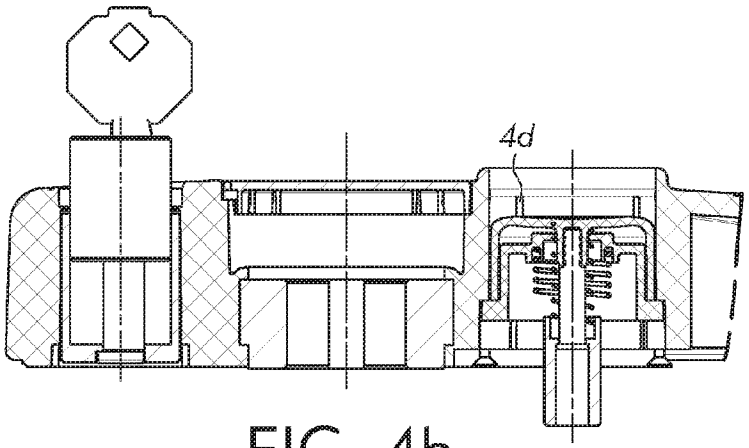
FIGS. 4*a* to 4*c* are views of the detail D of FIG. 2, wherein the operation of the safety system of the manoeuvring element according to the invention is highlighted.
Figure 4A:
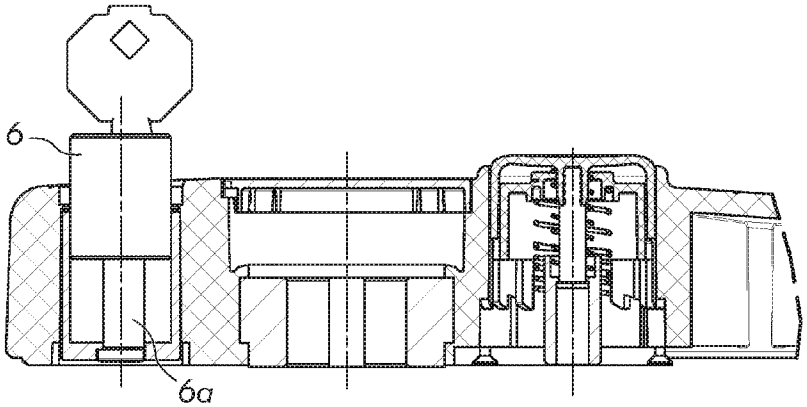
Figure 4C:
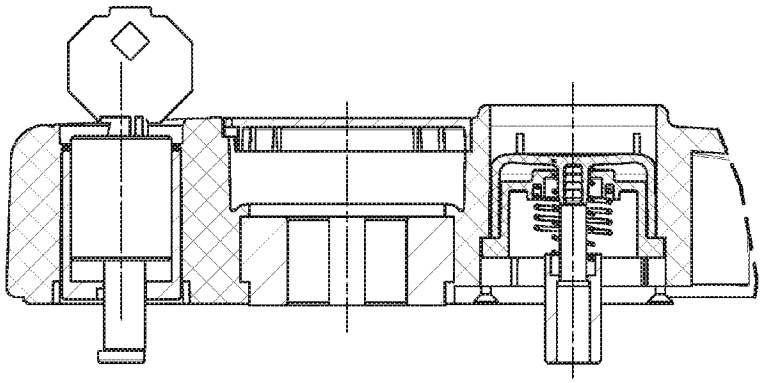

The manoeuvring element 1 according to this specification is easy to operate, particularly referring to FIGS. 4*a*-4*c*.

FIG. 4*a* shown manoeuvring element 1 in operating position: the safety system is entirely drawn back, and the operator can proceed with the displacement according to his/her needs. When the operator wishes to lock in the required position manoeuvring element 1, he applies on button 5 the pressure necessary for compressing springs 11 and 14 and for causing rotating insert 10 and button 5 to translate along cavity 4*b*. Once arrived at the maximum compression of spring 11, insert 10—for the particular engagement which has arisen between the bottom surface 5*c* of button 5 and the teeth 10*a* of insert 10—is caused to rotate, so that teeth 10*a* insert in a suitable protrusion of the inner wall of cavity 4*b*. At the same time, spring 14, compressed, tends to push out preloaded pin 13.

Once this first step has been completed, the operator will be able to rotate the key, so that lock assembly 6 causes the exit of pin 6*a*, and the consequent insertion into the suitable perforations provided on the body to displace.

The release of the safety system of the manoeuvring element will banally occur through the sole rotation of the key, with the resulting re-entry into home position of the lock assembly, and the consequent pressure on the button, which releases teeth 10*a* from the engagement position, and consequently to bring back the spring to the original position, with the consequent traction of the pin.

In case there is no perfect alignment between pin 13 and the complementary hole provided on the moving body on which the manoeuvring element is mounted, spring 14 is compressed and pin 13 is preloaded. Causing the manoeuvring element to rotate, the operator necessarily brings pin 13 in correspondence of the hole, understandably determining the release of spring 14 and the stable insertion of pin 13 into the hole.

As can be understood, by the system just described a manoeuvring element has been obtained provided with safety means such as to keep the bulk constant, both during movement and at rest.

Preferably, to keep the bulk to a minimum, the crank provides an ascending gradient from the gripping area to the engagement area.

It is understood that there may be other embodiments of the manoevring element according to the invention, different from the one described and illustrated in detail above, which achieve a usefulness equal to the ones described. For example, it is not necessary for the manoeuvring element to consist of a crank such as the one just described: it may be a steering wheel in a disc form or with spokes, or a device with two or three arms, with or without manoeuvring handle. Moreover, the locking means can be applied on the element in a position different from the one shown. Finally, a number of buttons greater than one may be provided. All these variants fall in the scope of protection of the present invention.

The invention claimed is:

1. A maneuvering element consisting of a crank rotatable about an axis x-x provided at one end of a protruding handle and at an opposite end of hollow bush which is configured to actuate rotation of a transmission shaft about the axis x-x, and furthermore provided with a safety system located between said ends of the crank, consisting of button means housed in a cavity obtained in said crank for the actuation of a locking pin that selectively prevents or allows rotation of said crank, wherein with said button means there are associated retaining means of said locking pin axially controlled by said button means and apt to rotate between a fastening position whereby the locking pin is extended outwards of said crank to prevent rotation of said crank, and an unlocking position whereby the locking pin is retracted into said crank to allow rotation of said crank, wherein said retaining means consist of a rotating insert consisting of a centrally drilled, substantially cylindrical body, externally provided with equidistant pins, a top surface of which is angled with respect to a resting plane that is defined as perpendicular to the axis x-x, wherein said rotating insert centrally carries a bush internally housing a first spring body that maintains elastic engagement between said button means and rotating insert, wherein the engagement between said button means and retaining means further occurs through a drawing pin engaged with said button means, wherein said drawing pin is inserted into and coaxial with said locking pin and slidingly engaged in a central open bore of said locking pin, the central bore of said locking pin having a retaining bottleneck, said drawing pin having a base having a slightly larger diameter than that of said retaining bottleneck, wherein a second spring body is housed above said bottleneck to thereby maintain said locking pin under tension to thereby resiliently bias said locking pin outwards of said crank, and wherein translational movement of the button means in a direction along said cavity directly causes corresponding translational movement of each of the rotating insert, drawing pin, and locking pin along said direction, whereby a compression of the second spring body causes said locking pin to be displaced and extended outwards of said crank.

2. The maneuvering element as claimed in claim 1) wherein said button means consist of a cylindrical body open below, and an upstanding hollow cylindrical element projecting centrally from an inner surface of the upper part of said cylindrical body, provided on an outer lateral surface with engaging ribbings with complementary grooves provided along walls of said cavity in which said button means are housed, and bearing on a bottom surface a wavy pattern.

3. The maneuvering element as in claim 1) wherein an angulation of said equidistant pins of the rotating insert is of 23°.

4. The maneuvering element as in claim 1) wherein said rotating insert provides on the top an outer circular crown which centrally carries the bush internally provided with an annular groove for the housing of the first spring body.

5. The maneuvering element as in claim 1) wherein the drawing pin is provided above with a dovetail insert, apt to engage with a central hole of said rotating insert and to engage with the upstanding hollow cylindrical element of said button means.

6. The maneuvering element as in claim 1) wherein that a flanged body is further provided apt to close said safety system below said cavity housing, the central hole of said flanged body being apt to allow the displacement outside said cavity of said locking pin.

7. The maneuvering element as in claim 6) wherein the first spring body maintains the elastic engagement between said button means and said flanged body and the second spring body maintains the elastic engagement between said button means and said locking pin.

8. The maneuvering element as in claim 1), further comprising a lock assembly, operable by a key, with an extendable pin that selectively prevents or allows rotation of said crank, wherein the lock assembly and safety system are mutually symmetrical with respect to the x-x axis of the crank.

* * * * *